United States Patent [19]

Anter et al.

[11] 3,999,354

[45] Dec. 28, 1976

[54] STRUCTURAL MEMBER AND BOX BEAM EMPLOYING SAME

[75] Inventors: Hans J. Anter, Riverside; John Galley, Rialto, both of Calif.

[73] Assignee: Alcan Aluminum Corporation, Cleveland, Ohio

[22] Filed: July 31, 1975

[21] Appl. No.: 600,602

[52] U.S. Cl. ..... 52/731; 29/155 R; 29/509; 52/738; 138/166; 403/274; 403/285

[51] Int. Cl.[2] ..... E04C 3/32

[58] Field of Search ..... 52/730–731, 52/738; 403/274, 282, 285; 138/162, 163, 166, 170; 29/509

[56] References Cited

UNITED STATES PATENTS

| | | | |
|---|---|---|---|
| 790,644 | 5/1905 | Lloyd | 403/285 X |
| 999,267 | 8/1911 | Slick | 52/731 |
| 2,266,593 | 12/1941 | Emmons | 29/155 R X |
| 3,043,407 | 7/1962 | Marryatt | 52/730 X |
| 3,789,563 | 2/1974 | Toti | 29/155 R X |
| 3,811,367 | 5/1974 | Bimba | 403/282 X |
| 3,837,755 | 9/1974 | Benoit et al. | 403/274 |

FOREIGN PATENTS OR APPLICATIONS

| | | | |
|---|---|---|---|
| 449,138 | 9/1927 | Germany | 52/731 |
| 956,494 | 4/1964 | United Kingdom | 138/162 |

*Primary Examiner*—Alfred C. Perham
*Attorney, Agent, or Firm*—Cooper, Dunham, Clark, Griffin & Moran

[57] ABSTRACT

This structural member is an elongated extruded part having a cross-sectional contour including a stitching leg adapted to be deformed together with the margin of an adjacent panel, so as to connect the member and the panel. The structural member disclosed is channel-shaped and has two stitching legs, one on either side of the channel. Each stitching leg cooperates with a wall of the channel to define a slot for receiving the margin of a panel. After the panel margin is inserted in the slot, the stitching leg and the panel are deformed together to connect the panel and the member. Two extruded structural members may be connected with two panels to form a box beam of hollow rectangular cross-section. Other polygonal cross-sections may be formed by connecting alternate extruded members and panels, with appropriate angles at their interconnections.

6 Claims, 6 Drawing Figures

Fig. 1.
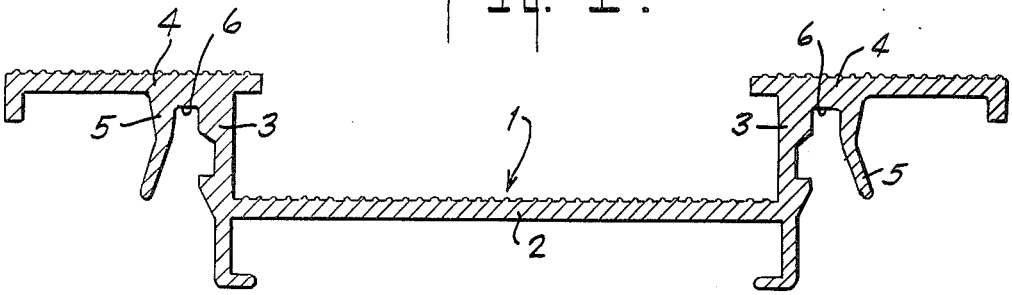
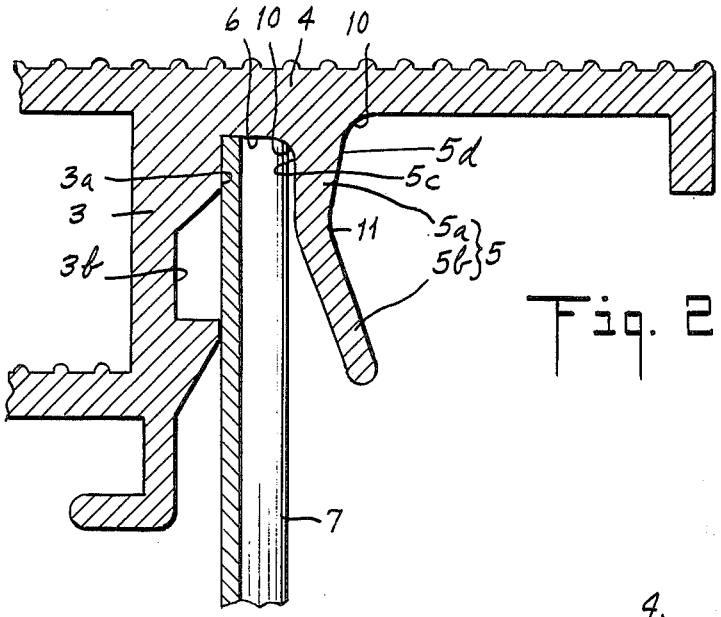
Fig. 2.
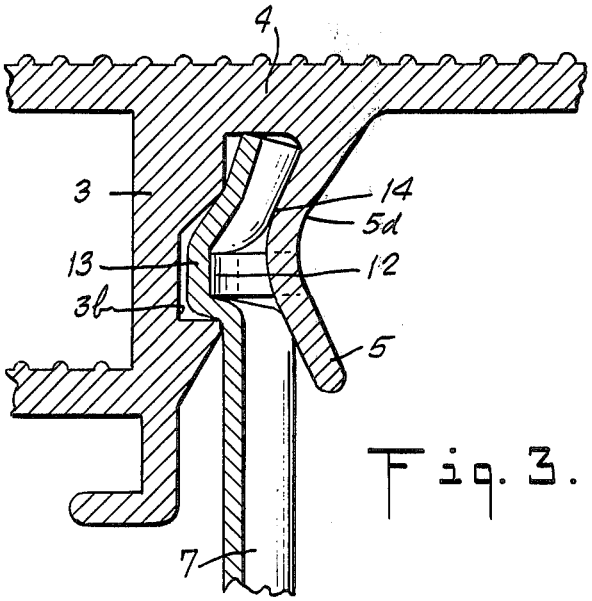
Fig. 3.

STRUCTURAL MEMBER AND BOX BEAM EMPLOYING SAME

CROSS REFERENCES

The beam of the present invention may be constructed by the use of the apparatus shown and claimed in the U.S. patent to Andrew J. Toti, U.S. Pat. No. 3,840,960, dated Oct. 14, 1974 and by the method shown and claimed in Toti U.S. Pat. No. 3,722,052, dated Mar. 27, 1973.

BRIEF SUMMARY

The Toti patents show a beam of hollow rectangular cross-section, which is built up of two extruded members and two panels, which may be either flat or corrugated. Each extruded member is formed on its opposite sides with slots adapted to receive margins of adjacent panels. After a panel margin is inserted in a slot, spaced localities of one side of the slot are deformed and forced, together with adjacent portions of the inserted panel, into a recess formed in the surface at the opposite side of the slot, so that the panel is gripped firmly between the sides of the slot.

The structural member of the present invention is improved over the extruded members shown in the Toti patents particularly in the contours of the opposite sides of the slot in which the panel margin is received and gripped. The recess in one side of that slot is of rectangular or trapezoidal cross-section, with the top edge tapered to allow insertion of panel without hanging up in slot rather than having undercut sides, as in the Toti patents. The stitching leg on the opposite side of the slot, which is the only part of the extruded member that is deformed in the gripping operation, consists of a tapered portion attached at its thickest part to the main body of the structural member and tapered to a junction, which is aligned with the top edge of the recess that receives the stitches. From the junction, the stitching leg flares outwardly in a marginal portion of uniform cross-section, which receives the panel margin freely and guides it into the bottom of the slot during the assembly of the beam.

This stitching leg structure is less subject to breakage than the prior art structures. The stitching leg contour and the recess contour cooperate to grip the panel margin tightly and hold it against the end of the slot.

DRAWINGS

FIG. 1 is a cross-sectional view of an elongated extruded structural member constructed in accordance with the invention.

FIG. 2 is a fragmentary view showing one side of the structural member of FIG. 1 assembled with the margin of a panel.

FIG. 3 is a view similar to FIG. 2, showing the stitching leg and the panel deformed to fasten the structural member and the panel together.

DETAILED DESCRIPTION

Figure 4:
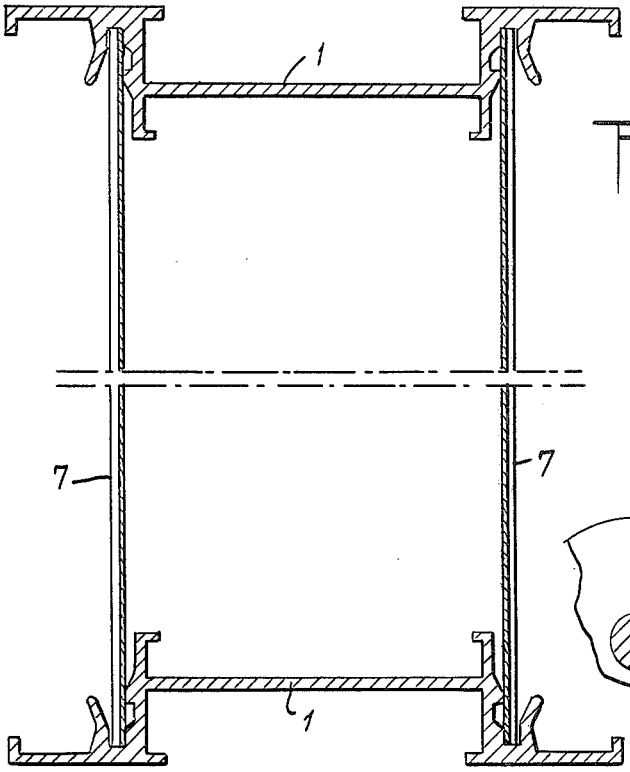
FIG. 4 is a cross-sectional view of an assembly of parts which is to form a beam of hollow rectangular cross-section, the assembly being composed of two extruded structural members and two channels.

FIG. 1 is a cross-sectional view of a structural member constructed in accordance with the invention, generally indicated by the reference numeral 1. Typically, this structural member 1 is extruded aluminum alloy, and has a substantial length. The member 1 includes a central web 2 and two upright walls 3 at the ends of the web. The walls 3 and the web 2 cooperate to define a generally channel-shaped cross-section. At the upper end of each wall 3 a flange 4 projects outwardly, away from the channel. A stitching leg 5 extends downwardly from each of the flanges 4. Each stitching leg cooperates with its associated flange 4 and wall 3 to define a slot 6. The slot 6 is adapted to receive the upper end of a panel 7, (FIGS. 2 and 3) which is preferred to be corrugated aluminum alloy sheet, although a flat panel of appropriate sheet material may alternatively be employed.

The stitching leg 5 comprises a tapered portion **5*a* and a marginal portion 5*b*. The tapered portion is thickest at the end where it joins the flange 4. The tapered portion 5*a* has an inner surface 5*c*, which is flat and parallel to the opposed outer surface 3*a* of the wall 3. The opposite surface 5*d* of the tapered portion extends diagonally from the flange 4 toward the surface 5*c*. The surfaces of the connection between tapered portion 5*a* and the flange 4 are formed by concave fillets 10. The marginal portion 5*b* is of uniform thickness and is joined to the tapered portion 5*a* at a junction 11. Junction 11 connects surface 5*d* with a surface 5*e* of the marginal portion 5*b* along a blend radius, which allows greater metal distribution along stitching leg 5** during the stitching process.

A recess **3*b* of trapezoidal cross-section is formed in the surface 3*a* of wall 3.** The beveled contour of the upper side of the recess is provided to facilitate smooth drawing of the panel metal into the recess, without tearing or cutting of the metal on the sharp upper corner. With sufficiently tough aluminum alloys, a square corner may be used, so that the recess is rectangular in cross-section.

After the margin of a panel 7 is inserted into the slot 6, the panel is permanently fastened to the member 1 by deforming spaced portions of the stitching leg 5 toward the wall 3 so as to engage and deform the intervening portions of the panel 7, as shown in FIG. 3, where a portion 12 of stitching leg 5 has been deformed toward the wall 3, thereby forcing a portion 13 of the panel 7 into the recess **3*b*. The panel 7 is thus tightly gripped between the stitching leg 5 and the wall 3.**

This operatb n of deforming portions 12 of the stitching leg 5 and portions 13 of the panel 7 is termed "stitching". It is done by simply forcing an appropriate tool against the outer surface of the stitching leg 5 in alignment with the middle of the recess **3*b*. This operation first forces a portion of the surface of the stitching leg 5 against the panel 7 as shown at 14 in FIG. 3. The upper margin of the panel 7 is thereby pinched at that locality and locked in place. The subsequent deformation of the panel is accomplished by drawing of the material of the panel 7 immediately adjacent the stitch, without pulling the upper end of the panel out of contact with the end of the slot 6. Furthermore, the deformation of the stitching leg 5 is accompanied by a stretchin g in the region of the outer surface 5*d* of the tapered portion 5*a*.**

The marginal portion 5*b* initially flares outwardly from the junction 11 away from the wall 3. Thus, it serves as a guide during the insertion of the panel 7 into the slot 6. As mentioned above, the beveled contour of the upper side of the recess 3*b* cooperates in this guiding action to facilitate smooth movement of the panel into the recess.

FIGS. 4, 5 AND 6

Figure 5:
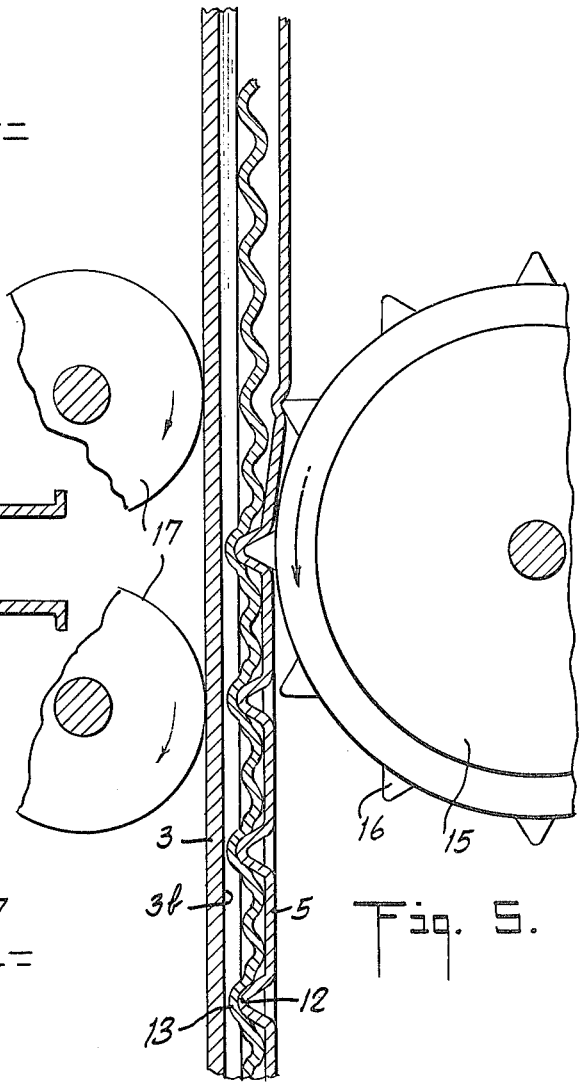
FIG. 5 is a view taken on the line 5—5 of FIG. 6, showing on an enlarged scale the stitching operation.
Figure 6:
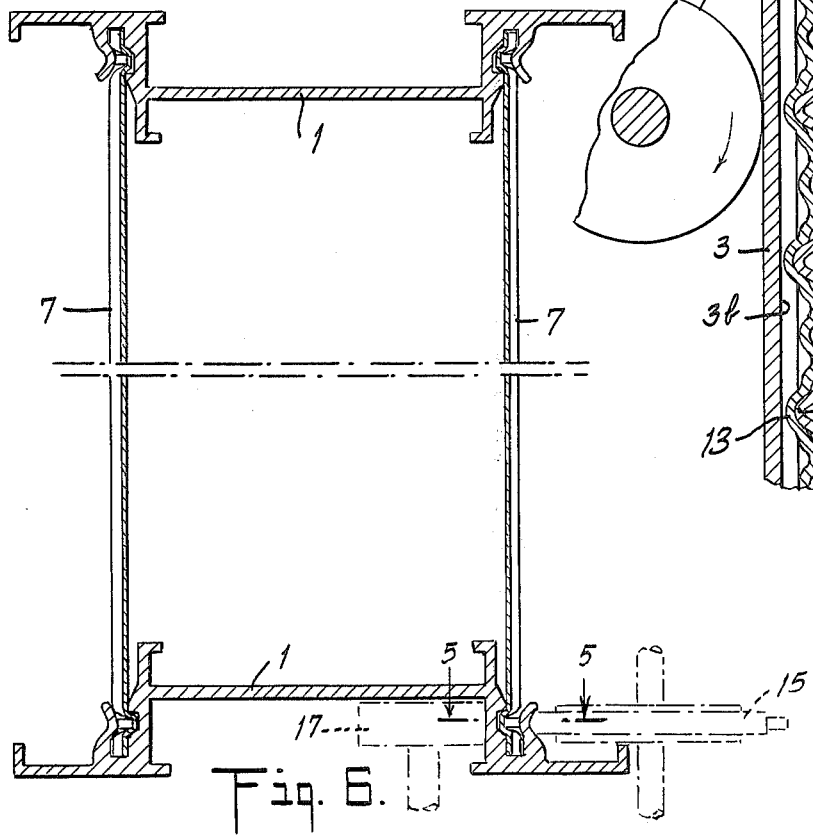
FIG. 6 is a view similar to FIG. 4, showing the completed beam after the stitching operation.

FIG. 4 shows the assembly of two structural members 1 with two panels 7. FIG. 5 shows, on a larger scale, the stitching of a leg 5 and associated corrugated panel 7 into a slot 3*b* of the wall 3. FIG. 6 shows the resultant box beam of hollow rectangular cross-section formed from the two structural members 1 and two panels 7, with each member 1 deformed at its opposite sides to tightly grip one edge of each of the two panels 7. Referring to FIG. 5, it may be seen that the stitching is accomplished by a wheel having teeth 16 which engage the stitching leg 5 at spaced intervals and drive portions of the stitching leg 5 and panel 7 into the recess 3*b* to form stitches 12, 13. The wall 3 is supported during this stitching operation by a pair of back-up rolls 17. It may be seen that the upper and lower margins of both panels 7 are received in the slots 6 of the structural members 1, and that the stitching legs 5 and the panels 7 are deformed to provide firm connections between the panels and the structural members.

Note that the stitching legs 5 have no narrow neck sections which may be fractured more easily than other parts thereof. Note also that the gripping of the margins of the panels 7 at the contact areas 14 is effective to lock the panels in place and prevent them from losing contact with the end of the slot 6. Consequently, any load on the beam is distributed uniformly, with all parts of the panels sharing the load. In prior art structures, the ends of the panels sometimes separated from the end of the channels during the stitching operation so that the load was transmitted from the panel through the stitch rather than through the end of the panel, with consequent unequal stressing of the panel structures.

While the box beam illustrated in FIG. 6 is of rectangular cross-section, it will be readily apparent that other polygonal cross-sections may be built up, using structural members with appropriate angles between the webs 1 and the gripping slots 6. There must always be an even number of structural members and panels. Hence, the next higher number of sides on a polygonal beam that could be used would be eight, resulting in an octagonal beam.

We claim:

1. An elongated structural member adapted for attachment to a margin of a panel, including:
   a. a wall;
   b. a flange projecting from said wall;
   c. a stitching leg projecting from the flange and opposed to and spaced from the wall, said wall, said flange and said leg defining a slot to receive the margin of the panel;
   d. said leg having a tapered portion attached to the flange and thickest at its connection with the flange and tapering from said connection to a marginal portion of uniform thickness;
   e. said wall having a elongated recess extending lengthwise of its surface and facing the marginal portion of said leg and adapted to receive deformed portions of the panel and the leg, to grip the panel between the leg and the wall.

2. A structural member as in claim 1, in which said recess is of trapezoidal cross-section, with the side nearest the flange beveled to facilitate movement of the edge of the panel into the slot.

3. A structural member as in claim 1, in which the tapered portion of the leg has a surface facing a surface of the wall and parallel thereto, and an opposite surface facing away from the wall and extending diagonally toward said parallel surface.

4. A structural member as in claim 1, in which:
   a. said marginal portion flares outwardly away from the wall; and
   b. said recess in the wall has it side nearest the flange contoured to cooperate with said marginal portion so as to guide the edge of a panel during insertion thereof into the slot.

5. A structural member as in claim 1, including:
   a. a second wall parallel to said first wall, a web connecting said walls so that said member has a channel-shaped cross-section;
   b. a second flange projecting from the second wall in a direction opposite to the flange on the first wall;
   c. a second leg projecting from the second flange and opposed to and spaced from the second wall, said second wall, second leg and second flange defining a second slot to receive the margin of a second panel;
   d. said second leg having a tapered portion and a marginal portion like those of the first-mentioned leg; and
   e. said second wall having an elongated recess like that of the first-mentioned wall.

6. A beam of hollow polygonal cross-section, including:
   a. an even number of panels;
   b. an equal number of elongated structural members, each having:
      1. two spaced side walls;
      2. two flanges, one projecting outwardly from each side wall;
      3. two stitching legs, one projecting from each flange and opposed to and spaced from the adjacent wall, each said wall, flange and leg cooperating to define a slot receiving one margin of one of said panels;
      4. each said leg having a tapered portion attached to the flange and thickest at its connection with the flange and tapering therefrom to a marginal portion of uniform thickness;
      5. each said wall having an elongated recess extending lengthwise of its surface and facing said marginal portion of the leg, each said recess having its side nearest the flange contoured to guide the edge of the panel during insertion into the slot; and
   c. said members and said panels being assembled with the margins of the panels received in said slots, portions of the legs and panels being deformed into the facing recesses so that the members and panels are locked together in a unitary beam.

* * * * *